United States Patent [19]

Gilman, Jr. et al.

[11] 3,979,213

[45] Sept. 7, 1976

[54] SPECTRALLY SENSITIZED SILVER HALIDE EMULSION CONTAINING AN INTERNAL METAL DOPANT

[76] Inventors: Paul B. Gilman, Jr.; Francis J. Evans; Gene L. Oliver, all of Kodak Park Works, Rochester, N.Y. 14650

[22] Filed: Aug. 19, 1974

[21] Appl. No.: 498,837

Related U.S. Application Data

[63] Continuation-in-part of Ser. No. 263,899, June 19, 1972, abandoned, which is a continuation of Ser. No. 56,702, July 20, 1970, abandoned.

[52] U.S. Cl. ..... 96/108; 96/120

[51] Int. Cl.[2] ..... G03C 1/28; G03C 1/02

[58] Field of Search ..... 96/120, 94 R, 108, 64, 96/114.7

[56] References Cited

UNITED STATES PATENTS

| | | | |
|---|---|---|---|
| 2,497,876 | 8/1948 | Fallesen et al. | 96/64 |
| 2,592,250 | 5/1949 | Davey et al. | 96/114.7 |
| 3,206,313 | 9/1965 | Porter et al. | 96/108 |
| 3,531,290 | 9/1970 | Litzermarr et al. | 96/107 |

*Primary Examiner*—Won H. Louie, Jr.
*Attorney, Agent, or Firm*—Carl O. Thomas

[57] ABSTRACT

This invention relates to improved spectral sensitization of silver halide emulsions containing silver halide grains having metal dopants occluded therein. In one aspect, methine dyes having a primary absorption peak at less than 700 millimicrons and a cathodic half-wave potential less positive than −1.0 volt can be incorporated in silver halide emulsions containing grains having metal dopants occluded therein at high concentrations which would normally cause considerable desensitization in a conventional surface-sensitive silver bromoiodide emulsion.

8 Claims, No Drawings

SPECTRALLY SENSITIZED SILVER HALIDE EMULSION CONTAINING AN INTERNAL METAL DOPANT

CROSS-REFERENCE TO RELATED APPLICATIONS

This is a continuation-in-part of Ser. No. 263,899, filed June 19, 1972, now abandoned which is in turn a continuation of application Ser. No. 56,702, filed July 20, 1970, now abandoned.

This invention relates to sensitization of internal-image emulsions. In one aspect, this invention relates to an unfogged, internal-image, silver halide emulsion containing metal dopants occluded therein and on its surface a sensitizing dye in a greater amount than the optimum for obtaining a good spectral-sensitizing effect with a surface-image silver halide emulsion. In another aspect, this invention relates to means for improving the spectral-sensitization characteristics of a negative silver halide emulsion having a metal dopant occluded therein.

It is well-known that certain sensitizing dyes can be added to fogged, direct-positive emulsions to improve reversal characteristics. While high concentrations of surface sensitizing dyes are not typically used, Falleson et al U.S. Pat. No. 2,497,876, issued Feb. 21, 1950, teaches the incorporation of acid merocyanine surface sensitizing dyes in the emulsion before coating in amounts of from 25 to 3000 milligrams of dye per 1000 grams of silver nitrate converted to silver halide. Falleson et al does not teach the application of these sensitizing dyes to silver halide emulsions containing internally occluded metal dopants or suggest any advantages for such an application as compared to the conversion-type internal image emulsions formed by the procedures described in Davey and Knott Canadian Pat. No. 491,513 (corresponding to abandoned U.S. Ser. No. 790,232, cited in column 7 of Falleson et al). It is also well-known in the art that many organic dyes will spectrally sensitize negative silver halide emulsions. However, one is limited in the amount of sensitizing dye that can be effectively used in negative, unfogged emulsions since desensitization takes place, lowering the photographic speed.

Generally, it is known in the photographic art that optimum spectral sensitization is obtained with organic dyes at 30% to 40% coverage of the total available surface area of the silver halide grains, as disclosed, for example, in West et al, "The Adsorption of Sensitizing Dyes in Photographic Emulsions," *Journal of Phys. Chem.*, Vol. 56, p. 1065, 1952, and Spence et al, "Densensitization by Sensitizing Dyes", *Journal of Physical and Colloid Chemistry*, Vol. 52, No. 6, June, 1948, pp. 1090–1103. Even lower concentrations are used when the organic sensitizing dye has a tendency to desensitize the silver halide emulsion, such as when the blue speed of the emulsion is decreased. In essence, desensitization of the emulsion usually occurs far below monolayer coverage so that most silver halide emulsions contain much less dye than the amount desirable for maximum absorption of light. Therefore, it would be desirable to provide silver halide emulsions that are not desensitized at high concentrations of sensitizing dye, allowing more total absorption of light and increased spectrally sensitized speed.

We have now found that internal-image silver halide emulsions containing metal dopants occluded therein respond more efficiently to high concentrations of spectral-sensitizing dye than silver halide emulsions of identical grain size chemically sensitized only on the surface or otherwise internally sensitized. The internal-image emulsions of this invention generally include those emulsions made by conversion techniques, core-shell emulsions with chemically sensitized cores, emulsions precipitated in the presence of foreign metal ions, and the like, and are characterized as containing grains having metal dopants occluded therein. The improved results are quite unexpected, especially in view of reports in "Colloque Sur la Sensibilite des Cristaux et des Emulsions Photographiques," *Science et Industries Photographiques*, 25A, 1952, pp. 137–156, which indicate that internal-image emulsions are desensitized in a similar manner as surface-sensitive emulsions.

In one aspect, this invention relates to a photographic element comprising a support and at least one layer containing a negative-working silver halide emulsion comprising silver halide grains substantially free of surface sensitivity and having metal dopants occluded therein. The radiation sensitivity is predominantly internal to the grains, and the grains have a spectral sensitizing dye adsorbed to their surfaces having a radiation absorption peak below 700 millimicrons and a cathodic halfwave potential less positive than −1.0 volt. The dye is present in a concentration which will lower the blue-speed sensitivity of a control sulfur and gold surface-sensitized silver bromoiodide emulsion, wherein the halide is 6 mole percent iodide and, of similar average grain size, at least 0.3 log E when developed for 3 minutes at 20°C in Kodak Developer D-19. Kodak Developer D-19 consists essentially of:

| | |
|---|---|
| N-methyl-p-aminophenol sulfate | 2.0 g |
| sodium sulfite, desiccated | 90.0 g |
| hydroquinone | 8.0 g |
| sodium carbonate, monhydrated | 52.5 g |
| potassium bromide | 5.0 g |
| water to | 1.0 liter. |

In a preferred embodiment, a methine sensitizing dye is used in a concentration of at least 1.5 and preferably at least 2 times the optimum effective concentration for spectrally sensitizing, negative, surface-sensitive emulsions, which is generally above at least 100 mg. of dye per mole of silver halide.

In another preferred embodiment, the sensitizing dyes are used at a concentration which would lower the blue-speed sensitivity of a control sulfur and gold surface-sensitized silver bromoiodide (6 mole percent iodide) emulsion of similar grain size and distribution at least 0.3 log E when developed at 25° C. in a surface developer such as Kodak D-19.

In another preferred embodiment, the sensitizng dye is used at a concentration which will provide at least 60% coverage of the total available surface of the silver halide grains and, in a highly preferred embodiment, at least 100% coverage of the total surface of the grains, i.e., at least that concentration which will provide a monolayer coverage of the total available surface area of the light-sensitive grains.

Generally, the internal-image emulsions of our invention comprise those which, when examined according to normal photographic testing techniques by coating a test portion of the emulsion on a transparent support, exposing to a light-intensity scale for a fixed time between $1 \times 10^{-6}$ and 1 second, bleaching 5 minutes in a 0.3% potassium ferricyanide solution at 65° F. and developing for about 5 minutes at 65° F. in Developer B below (an "internal-type" developer), have a sensitivity, measured at a density of 0.1 above fog, greater than the sensitivity of an identical test portion which has been exposed in the same way and developed for 6 minutes at 68° F. in Developer A below (a "surface-type" developer). Generally, the internal-image emulsions have a predominant amount of radiation sensitivity internal to the grain and preferably have a ratio of total sensitivity to surface sensitivity of greater than 10. Developer A is the usual type of surface-image developer and Developer B is an internal developer having high silver halide solvent activity.

| Developer A | |
|---|---|
| N-methyl-p-aminophenol sulfate | 2.5 g |
| ascorbic acid | 10.0 g |
| potassium metaborate | 35.0 g |
| potassium bromide | 1.0 g |
| water to 1 liter | |
| pH of 9.6 | |
| **Developer B** | |
| N-methyl-p-aminophenol sulfate | 2.0 g |
| sodium sulfite, desiccated | 90.0 g |
| hydroquinone | 8.0 g |
| sodium carbonate, monohydrate | 52.5 g |
| potassium bromide | 5.0 g |
| sodium thiosulfate | 10.0 g |
| water to 1 liter | |

Typical internal-image silver halide emulsions which are useful according to this invention contain silver halide grains or crystals having metal dopants occluded therein. The metal dopants can be occluded within the grain, for example, by precipitating in the presence of foreign metal ions (i.e., other than silver ions). The metal dopants can be introduced by chemically sensitizing a core of a silver halide grain to form a metal or metal salt thereon and then forming a shell or outer region on the core occluding the chemically sensitized site within the grain, etc. Typical useful silver halide emulsions containing grains having metal dopants occluded therein can be prepared by the procedures disclosed in Porter et al, U.S. Pat. No. 3,206,313 issued Sept. 14, 1965; Porter et al, U.S. Pat. No. 3,317,322 issued May 2, 1967; Berriman, U.S. Pat. No. 3,367,778 issued Feb. 6, 1968, omitting the surface fogging procedure; British Pat. No. 1,027,146; Bacon et al, U.S. Pat. No. 3,447,927 issued June 3, 1969; Bacon et al, U.S. Ser. No. 629,090 filed Apr. 7, 1967; Berriman, British Patent 1,151,782; McBride, U.S. Pat. No. 3,271,157 issued Sept. 6, 1966; and the like, including procedures which utilize rapid grain growth techniques as disclosed in Wilgus, U.S. Ser. No. 11,838 filed Feb. 16, 1970, and the like.

The silver halides used in the present invention are unfogged. Such silver halide emulsions contain no substantial developable or visible surface latent image.

In a preferred embodiment, the silver halide grains are formed in the presence of foreign metal ions and preferably polyvalent metal ions. Generally, when the grains are formed in an aqueous medium, the silver halide grains are formed in the presence of the water-soluble salts of the respective metal, preferably in an acidic medium. Typical useful polyvalent metal ions include trivalent metal ions such as antimony, bismuth, arsenic, gold, iridium, rhodium and the like and tetravalent metal ions such as platinum, osmium, iridium and the like. In highly preferred embodiments, the grains are formed in the presence of bismuth, lead or iridium ions. Generally, the silver halide grains contain at least $10^{-9}$ and preferably $10^{-3}$ mole percent of dopant based on silver halide.

The internal-image emulsions can also be formed by other methods which will yield a metal dopant occluded within the grain. It is understood, of course, that the term "metal dopant" refers to any metal ion or metal-containing compound which disrupts or changes the orderly silver ion-halide ion lattice in the silver halide grain or crystal, thus excluding silver ions. Therefore, the metal dopants useful according to this invention include such compounds as silver sulfide, silver telluride, silver selenide, metallic silver, gold sulfide, metallic gold, selenium, tellerium, and the like. Generally, any of the methods which are useful to produce centers which promote the deposition of photolytic silver can be used to provide the metal dopants within the silver halide grain. However, preferred metal dopants occluded within the grain contain at least one metal atom other than silver (i.e., a foreign metal atom) and, in certain highly preferred embodiments, the metal of the metal dopant is a trivalent or tetravlent metal ion.

The silver halide grains of the invention can also be surface-sensitized by techniques used to increase surface speed of silver halide emulsions. Typical techniques are disclosed in Porter et al, U.S. Pat. No. 3,317,322 issued May 2, 1967.

The sensitizing dyes useful in this invention generally include all dyes known to be useful in spectrally sensitizing, silver halide emulsions, and preferably are those characterized as methine or polymethine dyes. According to the present invention, the respective dyes are used in concentrations of a greater amount than that necessary for obtaining an optimum sensitizing effect with an emulsion which has been only surface-sensitized. In one preferred embodiment, the sensitizing dyes are used in concentrations which generally desensitize a surface-sensitive emulsion. In this embodiment, the sensitizing dyes are used at a concentration above that which will lower the blue-speed sensitivity of a sulfur- and gold-surface-sensitized, silver bromoiodide (6 mole percent iodide) emulsion at least 0.3 log E when developed in a surface developer such as Kodak D-19.

The dyes used in the emulsion combinations of this invention are characterized as being spectral-sensitizing dyes for silver halide emulsions and have a primary radiation-absorption peak below 700 millimicrons of the electromagnetic spectrum such as in the ultraviolet and visible regions of the spectrum. The dyes are further characterized as having a reduction potential or cathodic halfwave potential less positive than −1.0, i.e., such as cathodic halfwave potentials of −1.5, −2.0, etc.

Typical useful classes of dyes which can be used according to this invention include the methine dyes such as the cyanines, isocyanines, pseudocyanines, hemicyanines, merocyanines, oxanols, azacyanines and the like. Generally, any dye which can be used to sensitize spectrally a silver halide emulsion at low concentrations can now be used in high concentrations when used to sensitize spectrally the internal-image emulsions according to this invention, especially as set forth in the preferred embodiments of this invention wherein the internal-image emulsions comprise silver halide grains containing chemically formed, internal sensitivity sites.

The cathodic measurements can be made with a $1 \times 10^{-4}$ molar solution of the sensitizing dye in a solvent, for example, methanol which is 0.05 molar in lithium chloride using a dropping mercury electrode with the polarographic halfwave potential for the most positive cathodic wave being designated $E_c$. Anodic measurements can be made with $1 \times 10^{-4}$ molar aqueous solvent solution, for example, methanolic solutions of the electron acceptor which are 0.05 molar in sodium acetate and 0.005 molar in acetic acid using a carbon paste of pyrolytic graphite electrode, with the voltammetric half peak potential for the most negative anodic response being designated $E_a$. In each measurement, the reference electrode can be an aqueous silver —— silver chloride (saturated potassium chloride) electrode at 20° C. Electrochemical measurements of this type are known in the art and are described in *New Instrumental Methods in Electrochemistry*, by Delahay, Interscience Publishers, New York, New York, 1954; *Polarography*, by Kolthoff and Lingane, 2nd Edition, Interscience Publishers, New York, New York, 1952; *Analytical Chemistry*, 36, 2426 (1964), by Elving; and *Analytical Chemistry*, 30; 1576 (1958), by Adams. Plus and minus signs are according to IUPAC (International Union of Pure and Applied Chemistry) Stockholm Convention 1953.

The silver halide emulsions of this invention can be protected against the production of fog and can be stabilized against loss of sensitivity during keeping. Suitable antifoggants and stabilizers each used alone or in combination include thiazolium salts described in U.S. Pat. Nos. 2,131,038 by Brooker et al and 2,694,716 by Allen et al; the azaindenes described in U.S. Pat. Nos. 2,886,437 by Piper and 2,444,605 by Heimbach et al; the mercury salts as described in U.S. Pat. No. 2,728,663 by Allen et al; the urazoles described in U.S. Pat. No. 3,287,135 by Anderson et al; the sulfocatechols described in U.S. Pat. No. 3,236,652 by Kennard et al; the oximes described in British Patent 623,448 by Carroll et al; nitron; nitroindazoles; the mercaptotetrazoles described in U.S. Pat. Nos. 2,403,927 by Kendall et al, 3,266,897 by Kennard et al and 3,397,987 by Luckey et al; the polyvalent metal salts described in U.S. Pat. No. 2,839,405 by Jones; the thiuronium salts described in U.S. Pat. No. 3,220,839 by Herz et al; and the palladium, platinum and gold salts described in U.S. Pat. Nos. 2,556,263 by Trivelli et al and 2,597,915 by Yutzy et al.

The photographic elements of this invention may contain incorporated developing agents such as hydroquinones, catechols, aminophenols, 3-pyrazolidones, ascorbic acid and its derivatives, reductones and phenylenediamines. Combinations of developing agents can be employed in the practice of the invention. The developing agents can be in a silver halide emulsion and/or in another suitable location in the photographic element. The developing agents may be added from suitable solvents or in the form of dispersions as described in Yackel, U.S. Pat. No. 2,592,368, and Dunn et al, French Patent 1,505,778.

The photographic and other hardenable layers used in the practice of this invention can be hardened by various organic or inorganic hardeners, alone or in combination, such as the aldehydes, and blocked aldehydes, ketones, carboxylic and carbonic acid derivatives, sulfonate esters, sulfonyl halides and vinyl sulfonyl ethers, active halogen compounds, epoxy compounds, aziridines, active olefins, isocyanates, carbodiimides, mixed-function hardeners and polymeric hardeners such as oxidized polysaccharides like dialdehyde starch and oxyguargum and the like.

The photographic emulsions and elements described in the practice of this invention can contain various colloids alone or in combination as vehicles, binding agents and various layers. Suitable hydrophilic materials include both naturally occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinylpyrrolidone), acrylamide polymers and the like.

The described photographic emulsion layers and other layers of a photographic element employed in the practice of this invention can also contain, alone or in combination with hydrophilic, water-permeable colloids, other synthetic polymeric compounds such as dispersed vinyl compounds such as in latex form and particularly those which increase the dimensional stability of the photographic materials. Suitable synthetic polymers include those described, for example, in U.S. Pat. Nos. 3,142,568 by Nottorf issued July 28, 1964; 3,193,386 by White issued July 6, 1965; 3,062,674 by Houck et al issued Nov. 6, 1962; 3,220,844 by Houck et al issued Nov. 30, 1965; 3,287,289 by Ream et al issued Nov. 22, 1966; and 3,411,911 by Dykstra issued Nov. 19, 1968; particularly effective are those water-insoluble polymers of alkyl acrylates and methacrylates, acrylic acid, sulfoalkyl acrylates or methacrylates, those which have cross-linking sites which facilitate hardening or curing, those having recurring sulfobetaine units as described in Canadian Patent No. 774,054 by Dykstra.

The photographic layers and other layers of a photographic element employed and described herein can be coated on a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like. Typically, a flexible support is employed, especially a paper support, which can be partially acetylated or coated with baryta and/or an alpha-olefin polymer, particularly a polymer of an alpha-olefin containing 2 to 10 carbon atoms such as polyethylene, polypropylene, ethylenebutene copolymers and the like.

This invention may be used with elements designed for colloid transfer processes such as described in U.S. Pat. No. 2,716,059 by Yutzy et al; silver salt diffusion transfer processes such as described in U.S. Pat. Nos. 2,352,014 by Rott, 2,543,181 by Land, 3,020,155 by Yackel et al and 2,861,885 by Land; color image transfer processes such as described in U.S. Pat. Nos. 3,087,817, 3,185,567 and 2,983,606 by Rogers, 3,253,915 by Weyerts et al, 3,227,550 by Whitmore et al, 3,227,551 by Barr et al, 3,227,552 by Whitmore and 3,415,644, 3,415,645 and 3,415,646 by Land; and imbibition transfer processes as described in U.S. Pat. No. 2,882,156 by Minsk.

This invention may be used with elements designed for color photography, for example, elements containing color-forming couplers such as those described in U.S. Pat. Nos. 2,376,679 by Frohlich et al, 2,322,027 by Jelley et al, 2,801,171 by Fierke et al, 2,698,794 by Godowsky, 3,227,554 by Barr et al and 3,046,129 by Graham et al; or elements to be developed in solutions containing color-forming couplers such as those described in U.S. Pat. Nos. 2,252,718 by Mannes et al, 2,592,243 by Carroll et al and 2,950,970 by Schwan et al; and in false-sensitized color materials such as those described in U.S. Pat. No. 2,763,549 by Hanson.

Photographic elements prepared according to this invention can be processed by various methods which utilize internal-image silver halide developing compositions containing silver halide solvents and developing agents such as hydroquinones, catechols, aminophenols, 3-pyrazolidones, phenylenediamines, ascorbic acid derivatives, hydroxylamines, hydrazines, reductones and the like including procedures such as web processing as described in U.S. Patent 3,179,517 by Tregillus et al; stabilization processing as described in Russell et al, "Stabilization Processing of Films and Papers," *PSA Journal*, Vol. 16B, August, 1950; monobath processing as described in Levy, "Combined Development and Fixation of Photographic Images with Monobaths", *Phot. Sci. and Eng.*, Vol. 2, No. 3, October, 1958, and Barnes et al, U.S. Pat. No. 3,392,019. If desired, the photographic elements of this invention can be processed in hardening developers such as those described in U.S. Pat. No. 3,232,761 by Allen et al; in roller transport processors such as those described in U.S. Pat. No. 3,025,779 by Russell et al; or by surface application processing as described in Example 3 of U.S. Pat. No. 3,418,132 by Kitze.

The invention can be further illustrated by the following examples of preferred embodiments thereof.

EXAMPLE 1

Preparation of a control surface-sensitive emulsion and an internal-image emulsion containing grains having metal dopants occluded therein A silver bromide emulsion is prepared by mixing simultaneously over a period of 28 minutes at a temperature of 70° C. equal molar solutions of silver nitrate and sodium bromide using an automatic controlled silver halide precipitation technique. Upon completion of the precipitation, octahedral crystals having a diameter of 0.5 micron result.

The emulsion is then split into two equal portions, Emulsions A and B, and subjected to the following separate conditions.

Emulsion A — The 0.5-micron silver bromide grains are further grown, in the same precipitation environment as the first precipitation, for 28 minutes, with a total time of the combined precipitations 56 minutes, such that the final crystalline structure results in octahedral grains 0.8 micron in diameter.

Emulsion B — The 0.5-micron silver bromide grains are chemically sensitized by adding 1.7 mg. of sodium thiosulfate/silver mole and 2.5 mg. of potassium chloroaurate/silver mole and heating for 30 minutes at 70° C. The chemically sensitized grains are then covered by a procedure similar to that described for Emulsion A. The resulting crystalline structure and size are identical to Emulsion A, but contain a metal dopant occluded therein.

Emulsions A and B are then grain-washed as described in Yutzy, U.S. Pat. No. 2,614,928. Emulsion A is chemically sensitized at the surface of the grain by adding 1.4 mg. of sodium thiosulfate/silver mole and 2.1 mg. of potassium chloroaurate/silver mole and heating for 20 minutes at 20° C. The emulsions are then coated on a polyethylene terephthalate film support at 150 mg. of silver/ft$^2$ and exposed for 1/1000 second on a Bausch and Lomb Spectrograph.

EXAMPLE 2

To separate portions of the surface-sensitive emulsion, emulsion A, and the internal-sensitive emulsion, Emulsion B, of Example 1, are added the spectral-sensitizing dyes as listed in the following table. The dyed emulsions are coated, then exposed and processed.

The surface-sensitive emulsions are developed for 5 minutes in an Elon-hydroquinone developer, fixed, washed and dried.

The internal-image emulsions are developed in an Elon-hydroquinone developer containing 0.5 g./liter of potassium iodide, then fixed, washed and dried.

Table 1

| Emulsion | Sensitizing Dye(mg./m.) | Relative Blue Speed | Relative Minus Blue Speed | Sensitizing Peak in nm. |
|---|---|---|---|---|
| Emulsion A | control | 100 | — | 400 |
| Emulsion A | 1 (200) | 50 | 400 | 578 |
| Emulsion A | 1 (400) | 25 | 200 | 578 |
| Emulsion A | 1 (800) | 25 | 400 | 578 |
| Emulsion B | control | 150 | — | 400 |
| Emulsion B | 1 (200) | 150 | 800 | 578 |
| Emulsion B | 1 (400) | 200 | 1600 | 578 |
| Emulsion B | 1 (800) | 400 | 3200 | 578 |
| Emulsion A | 2 (200) | 12 | 800 | 525 |
| Emulsion A | 2 (400) | 3 | 1600 | 525 |
| Emulsion B | 2 (200) | 800 | 800 | 525 |
| Emulsion B | 2 (400) | 600 | 1600 | 525 |
| Emulsion A | 3 (200) | 50 | 200 | 640 |
| Emulsion A | 3 (400) | 12 | 100 | 640 |
| Emulsion A | 3 (800) | 3 | 6 | 640 |
| Emulsion B | 3 (200) | 200 | 800 | 640 |
| Emulsion B | 3 (400) | 400 | 1600 | 640 |
| Emulsion B | 3 (800) | 400 | 3200 | 640 |
| Emulsion A | 4 (100) | 75 | 150 | 530 |
| Emulsion A | 4 (200) | 50 | 100 | 530 |
| Emulsion A | 4 (300) | 10 | 50 | 530 |
| Emulsion B | 4 (100) | 100 | 400 | 530 |
| Emulsion B | 4 (200) | 100 | 1600 | 530 |
| Emulsion B | 4 (300) | 75 | 1600 | 530 |
| Emulsion A | 5 (100) | 100 | 100 | 625 |
| Emulsion A | 5 (200) | 25 | 75 | 625 |
| Emulsion A | 5 (300) | 5 | 25 | 625 |
| Emulsion B | 5 (100) | 200 | 3200 | 625 |
| Emulsion B | 5 (200) | 150 | 3200 | 625 |

Table 1-continued

| | | | | |
|---|---|---|---|---|
| Emulsion B | 5 (300) | 100 | 1600 | 625 |

It can be seen from the above table that the internal-sensitive emulsion containing grains having metal dopants occluded therein is far superior in photographic speed at higher levels of spectral-sensitizing dye than an identical grain size emulsion having surface sensitivity.

Dye 1 — anhydro-5,5′-6,6′-tetrachloro-1,1′-diethyl-3,3′-di-(3-sulfobutyl)benzimidazolocarbocyanine hydroxide ($E_c$ is -1.6, $E_a$ is +0.52).

Dye 2 — 1-carboxymethyl-5-[(3-ethyl-2-benzoxazolinylidene)ethylidene]-3-phenyl-2-thiohydantoin ($E_c$ is −1.50, $E_a$ is +0.28).

Dye 3 — 3,3′,9-triethyl-5,5′-dichlorothiacarbocyanine bromide ($E_c$ is −1.06, $E_a$ is +0.69).

Dye 4 — 3-ethyl-5-[(3-ethyl-2-benzothiazolinylidene)-1-methylethylidene]-2-thio-2,4-oxazolidinedione ($E_c$ is −1.42, $E_a$ is +0.57).

Dye 5 — 3,3′-diethyl-9-methyl thiacarbocyanine bromide ($E_c$ is −1.16, $E_a$ is +0.57).

Similar improved speed results are obtained with Emulsion B, as compared with Emulsion A, when the following spectral-sensitizing dyes are incorporated in the emulsion at higher than normal sensitizing levels for surface-sensitized emulsions:

| Dye | Spectral Sensitization to (mμ) |
|---|---|
| 3-carboxymethyl-5-(3-ethyl-4-methyl-2(3)-thiazolylidene)rhodanine ($E_c$ is −1.81, $E_a$ is +0.72) | 490 |
| 6,6′-dichloro-1,1′,3,3′-tetraphenylimidazo-[4,5-b]quinoxalinocyanine perchlorate ($E_c$ is −1.82, $E_a$ is +0.43) | 494 |
| 1,1′,3,3′-tetraethyl benzimidazolocarbocyanine iodide ($E_c$ is −1.75, $E_a$ is +0.19) | 550 |
| 3-ethyl-5-[1-(4-sulfobutyl)-4-(1H)-pyridylidene]rhodanine, sodium salt ($E_c$ is −1.70, $E_a$ is +0.42) | 555 |
| 5-[3-ethyl-2(3H)benzoxazylidene]-3-phenyl rhodanine ($E_c$ is −1.72, $E_a$ is +0.69) | 500 |
| 3-carboxymethyl-5-(3-methyl-2-benzoxazolinylidene)rhodanine ($E_c$ is −1.76, $E_a$ is +0.89) | 500 |
| 3-ethyl-5-(1-ethyl-4(1H)-pyridylidene)rhodanine ($E_c$ is −1.68, $E_a$ is +0.56) | 530 |
| 1′,2′-diethylthio-2′-carbocyanine iodide ($E_c$ is −1.60, $E_a$ is +0.95) | 690 |
| 3-carboxymethyl-5-(3-ethyl-2(3H)-benzothiazolylidene)rhodanine ($E_c$ is −1.60, $E_a$ is +0.73) | 510 |
| 5,5′,6,6′-tetrachloro-1,1′,3,3′-tetraethylbenzimidazolocarbocyanine iodide ($E_c$ is −1.50, $E_a$ is +0.58) | 690 |
| 3,3′-diethylselenacyanine iodide ($E_c$ is −1.58, $E_a$ is >+1.0) | 500 |
| 3-carboxymethyl-5-[(3-methyl-2(3)-thiazolinylidene)isopropylidene]rhodanine ($E_c$ is −1.47, $E_a$ is +0.33) | 580 |
| 5-[(5,6-dichloro-1,3-diethyl-2-benzimidazolinylidene)ethylidene]-3-(3-dimethylaminopropyl)-rhodanine ($E_c$ is −1.49, $E_a$ is +0.40) | 595 |
| 5-[(1-ethylnaphtho[1,2-d]thiazolin-2-ylidene)-ethylidene]-3-heptyl-1-phenyl-2-thiohydantoin ($E_c$ is −1.41, $E_a$ is +0.40) | 650 |
| anhydro-5,6-dichloro-1,3′-diethyl-3-(3-sulfopropyl)benzimidazolo-oxa-carbocyanine hydroxide ($E_c$ is −1.45, $E_a$ is +0.70) | 600 |
| 3-carboxymethyl-5-[β-(3-ethyl-2(3)-benzothiazolylidene)ethylidene]rhodanine ($E_c$ is −1.36, $E_a$ is +0.33) | 640 |
| 4-[(1-ethyl-2(1)-β-naphthothiazolylidene)isopropylidene]-3-methyl-1-(p-sulfophenyl)-5-pyrazolone ($E_c$ is −1.31, $E_a$ is +0.48) | 550 |
| anhydro-9-ethyl-5,5′-diphenyl-3,3′-di(3-sulfobutyl)oxacarbocyanine hydroxide monosodium salt ($E_c$ is −1.38, $E_a$ is +0.69) | 570 |
| 3,3′-diethyl-4′-methyloxathiazolocarbocyanine iodide ($E_c$ is −1.33, $E_a$ is +0.41) | 580 |
| 5,5′,6,6′-tetrachloro-1,1′,3,3′-tetraethylbenzimidazolodicarbocyanine iodide ($E_c$ is −1.28, $E_a$ is +0.27) | 670 |
| anhydro-5,5′-dichloro-9-ethyl-3,3′-di(3-sulfopropyl)oxacarbocyanine hydroxide sodium salt ($E_c$ is −1.26, $E_a$ is +0.82) | 550 |
| 3,3′-diethyloxacarbocyanine iodide ($E_c$ is −1.26, $E_a$ is +0.94) | 550 |
| 3,3′-dimethyl-9-phenyl-4,5,4′,5′-dibenzothiacarbocyanine bromide ($E_c$ is −1.29, $E_a$ is +0.63) | 700 |
| 5,5′-dichloro-3,8;3′,10-diethylenethiacarbocyanine paratoluene sulfonate ($E_c$ is −1.20, $E_a$ is +0.46) | 720 |
| 3,8;3′,10-di(1,3-butylene)-9-methylthiacarbocyanine iodide ($E_c$ is −1.25, $E_a$ is +0.43) | 660 |

-continued

| Dye | Spectral Sensitization to (mμ) |
|---|---|
| 3-ethyl-5-[(3-methyl-2-thiazolidinylidene)ethylidene]-2-[(3-methyl-2-thiazolidinylidene)-1-propenyl]-4-oxo-1-phenyl-2-imidazolinium iodide ($E_c$ is −1.15, $E_a$ is +0.38) | 700 |
| 3,3'-di(4-sulfobutyl)thiacarbocyanine iodide, sodium salt ($E_c$ is −1.10, $E_a$ is +0.70) | 640 |
| 3-ethyl-2-methyl-5-[(3-methyl-2-thiazolidinylidene)ethylidene]-4-oxo-1-phenyl-2-imidazolinium perchlorate ($E_c$ is −1.10, $E_a$ is +0.84) | 500 |
| 2-(2-benzothiazolyl)imino-3-ethyl-5-[(3-ethyl-2-benzoxazolinylidene)ethylidene]-4-thiazolidinone ($E_c$ is −1.49, $E_a$ is +0.45) | 600 |
| anhydro-1'-ethyl-3-(3-sulfobutyl)thia-2'-cyanine hydroxide ($E_c$ is −1.13, $E_a$ is +0.95) | 560 |
| anhydro-5,5'-dichloro-9-ethyl-3,3'-di(3-sulfopropyl)thiacarbocyanine hydroxide ($E_c$ is −1.16, $E_a$ is +0.65) | 680 |
| 1,1'-ethylene-2,2'-cyanine iodide ($E_c$ is −1.00, $E_a$ is >+1.00) | 565 |
| 1'-ethyl-2-methylthia-2'-cyanine iodide ($E_c$ is −1.08, $E_a$ is +0.96) | 540 |
| 1,1'-diethyl-2,2'-dicyanine iodide ($E_c$ is −1.03, $E_a$ is +0.99) | 570 |
| 9-methyl-3,8;3',10-ditrimethylene thiacarbocyanine paratoluene sulfonate ($E_c$ is −1.08, $E_a$ is +0.66) | 660 |
| 1,1'-dimethyl-4-carboxycyanine iodide ($E_c$ is −1.01, $E_a$ is >+1.00) | 580 |

EXAMPLE 3

A silver bromoiodide emulsion is prepared by a procedure similar to that described in Trivelli and Smith, *Phot. J.*, Vol. LXXIX, pp. 330–338 (1939). The emulsion is chemically sensitized similar to that described in Example 1, Emulsion B, and split into two equal portions.

One portion of the above emulsion is covered with a silver salt by the procedure described in Example 5 of U.S. Pat. No. 3,206,313 by Porter, such that an internal-sensitive silver halide emulsion results. The remaining portion receives no further treatment, thus resulting in an external-sensitive silver halide emulsion.

Table 2

| Emulsion Sensitivity | Sensitizing Dye (mg./m.) | Relative Blue Speed | Relative Minus Blue Speed | Sensitizing Peak in nm. |
|---|---|---|---|---|
| external | none (control) | 100 | — | — |
| external | 4 (100) | 45 | 100 | 543 |
| external | 4 (650) | 10 | 47 | 543 |
| internal | none (control) | 100 | — | — |
| internal | 4 (100) | 55 | 100 | 543 |
| internal | 4 (650) | 37 | 89 | 543 |

Separate aliquot portions of the above internal- and external-sensitive emulsions are spectrally sensitized, as described in Table 2 with Dye 4 of Example 2, coated on a polyethylene terephthalate film support, exposed and developed according to their sensitivity as described in Example 2.

EXAMPLE 4

An internal-image emulsion, a bromoiodide emulsion (2.5 mole percent iodide) having an average grain size of 0.2 micron, is prepared by adding 106 mg. of potassium hexachloroiridate/mole of silver to the gelatin solution prior to the precipitation of the silver halide. The emulsion is divided into separate aliquot portions and to the portions are added 250, 500, 700 and 900 mg. of the sensitizing dye anhydro-3,9-diethyl-5,5'-dimethoxy-3'-(3-sulfopropyl)thiacarbocyanine hydroxide per silver mole ($E_c$ is −1.19 and $E_a$ is +0.62). The emulsion samples are then coated on a film support at 100 mg. of silver/ft.$^2$. After exposing the coated samples on an Eastman 1B Sensitometer, the samples are developed in the internal-image developer of the following formula:

| | |
|---|---|
| 1-phenyl-3-pyrazolidone | 10.0 g. |
| sodium isoascorbate | 40.0 g. |
| sodium hydroxide | 30.0 g. |
| sodium sulfite | 20.0 g. |
| 1-phenyl-4-mercaptotetrazole | 0.25 g. |
| potassium bromide | 5.0 g. |
| potassium iodide | 00.5 g. |
| distilled water to 1 liter | |

The results show no desensitization in the inherent sensitivity of the emulsion and the best spectral response (640 nm) is obtained at 900 mg. dye/silver mole.

Similar results are obtained when the silver halide emulsion contains osmium ions, bismuth ions or rhodium ions occluded in the grain.

EXAMPLE 5

An internal-image emulsion is prepared similar to that described in Example 4 with 900 mg. of said dye per silver mole. The emulsion is coated at 100 mg. silver/ft$^2$ on a film support and exposed to 20 foot candles of illumination for 5 seconds through a line image. The coating is then rolled in contact with a receiver and a viscous pod of the type described in U.S. Pat. No. 2,823,122. After 10 seconds, the receiver is separated from the film support and on the receiving layer remains a high-quality positive image.

Although the invention has been described in considerable detail with particular reference to certain preferred embodiments thereof, variations and modifications can be effected within the spirit and scope of the invention.

We claim:

1. A photographic element comprising a support and at least one layer containing a negative-working silver halide emulsion comprising silver halide grains substantially free of surface sensitivity and having metal dopants occluded therein and wherein the radiation sensitivity is predominantly internal to said grains and wherein said grains have a spectral sensitizing dye adsorbed to the surface of said grains having a radiation absorption peak below 700 millimicrons and a cathodic halfwave potential less positive than −1.0 volt present in a concentration which will lower the blue-speed sensitivity of a control sulfur and gold surface-sensitized silver bromoiodide emulsion, wherein the halide is 6 mole percent iodide, of similar average grain size at least 0.3 log E when developed for 3 minutes at 20°C in Kodak Developer D-19 consisting essentially of:

| | |
|---|---|
| N-methyl-p-aminophenol sulfate | 2.0 g |
| sodium sulfite, desiccated | 90.0 g |
| hydroquinone | 8.0 g |
| sodium carbonate, monohydrated | 52.5 g |

-continued

| | |
|---|---|
| potassium bromide | 5.0 g |
| water to | 1.0 liter. |

2. A photographic element according to claim 1 wherein said sensitizing dye is a methine dye used in a concentration which will provide at least 60% coverage of the total available surface of the silver halide grains.

3. A photographic element according to claim 1 wherein said sensitizing dye is used in a concentration which will provide at least monolayer coverage of the total available surface of the silver halide grains.

4. A photographic element according to claim 1 wherein said silver halide grains have trivalent or tetravalent metal ions occluded therein.

5. A photographic element according to claim 1 wherein said silver halide grains are core-shell structures wherein the core has been chemically sensitized before the shell is formed thereon.

6. A photographic element according to claim 1 wherein said sensitizing dye is used in a concentration of at least 1.5 times the optimum effective concentration for spectrally sensitizing, negative, surface-sensitive emulsions.

7. A photographic element according to claim 1 wherein said silver halide grains have bismuth ions, lead ions or iridium ions occluded therein.

8. A photographic element according to claim 1 wherein said silver halide grains have iridium ions occluded therein.

* * * * *